US011473307B2

(12) United States Patent
Smyth

(10) Patent No.: US 11,473,307 B2
(45) Date of Patent: Oct. 18, 2022

(54) SKYLIGHT AND SMOKE VENT GUTTER UPLIFT CHANNEL ASSEMBLY

(71) Applicant: Greg Smyth, Trenton, GA (US)

(72) Inventor: Greg Smyth, Trenton, GA (US)

( * ) Notice: Subject to any disclaimer, the term of this patent is extended or adjusted under 35 U.S.C. 154(b) by 98 days.

(21) Appl. No.: 17/014,995

(22) Filed: Sep. 8, 2020

(65) Prior Publication Data

US 2021/0071424 A1 Mar. 11, 2021

Related U.S. Application Data

(60) Provisional application No. 62/896,536, filed on Sep. 5, 2019.

(51) Int. Cl.
*E04D 13/03* (2006.01)
*E04D 13/04* (2006.01)

(52) U.S. Cl.
CPC ..... *E04D 13/0315* (2013.01); *E04D 13/0325* (2013.01); *E04D 13/0445* (2013.01)

(58) Field of Classification Search
CPC .. E04D 3/366; E04D 3/06; E04D 3/08; E04D 13/03; E04D 13/0445; E04D 13/0305; E04D 13/031; E04D 13/0315; E04D 13/032; E04D 13/0325; E04D 2003/0893; E04D 2003/0818; E04D 2003/0856; E04D 2003/0837; E04D 2003/0843
USPC ..... 52/200
See application file for complete search history.

(56) References Cited

U.S. PATENT DOCUMENTS 788,538 A * 5/1905 Eberhard ..... E04D 3/08 52/459
850,487 A * 4/1907 Plass ..... E04D 3/08 52/395
937,667 A * 10/1909 Wessels ..... E04D 3/08 52/395
947,009 A * 1/1910 Windeknecht ..... E04D 3/08 52/395
1,156,981 A * 10/1915 Crocker ..... E04D 3/08 52/463
1,167,553 A * 1/1916 Breneman ..... E04D 3/08 52/549
1,209,378 A * 12/1916 Barks ..... E04D 3/08 52/459
1,527,159 A * 2/1925 Hauserman ..... E04D 3/06 52/395
1,543,330 A * 6/1925 Grenier ..... E04D 3/08 52/95
1,812,009 A * 6/1931 Lenke ..... E04D 3/08 52/461

(Continued)

*Primary Examiner* — Kyle J. Walraed-Sullivan
(74) *Attorney, Agent, or Firm* — Mark A. Pitchford; Eric B. Fugett

(57) ABSTRACT

A gutter uplift channel assembly is configured to mount skylights, smoke vents, or other roof accessories to a roof having a pair of longitudinally extending roof curbs. A gutter extends between the pair of roof curbs and is secured to the roof curbs to channel water laterally over the roof curbs. The gutter receives longitudinal ends of a pair of roof accessories to be mounted next to each other. An uplift channel or cap of the gutter channel assembly extends over the longitudinal ends or rims of the roof accessories and is secured to the gutter via threaded rods extending up from the gutter through corresponding holes in the uplift channel and nuts placed on the threaded rods.

16 Claims, 7 Drawing Sheets

(56) References Cited

U.S. PATENT DOCUMENTS 1,873,789 A * 8/1932 Rupertus ..... E04D 3/08 52/461
RE19,109 E * 3/1934 Rupertus ..... E04D 3/08 52/395
1,968,125 A * 7/1934 Cibulas ..... E04D 3/08 52/459
1,968,363 A * 7/1934 Wilson ..... E04D 3/08 52/395
2,102,902 A * 12/1937 Lenke ..... E04D 3/08 411/116
2,842,073 A * 7/1958 Huston ..... E04D 13/032 52/200
4,114,330 A * 9/1978 Sukolics ..... E04D 3/08 52/460
4,123,883 A * 11/1978 Barber, Jr. ..... F24S 80/40 52/475.1
4,621,466 A * 11/1986 Sonneborn ..... E04D 3/366 52/211
4,680,905 A * 7/1987 Rockar ..... E04D 3/08 52/200
RE32,539 E * 11/1987 Jentoft ..... E04D 13/0305 52/200
4,703,596 A * 11/1987 Sandow ..... E04D 3/366 52/200
4,850,167 A * 7/1989 Beard ..... E04D 3/08 52/200
4,996,809 A * 3/1991 Beard ..... E04D 3/08 52/235
5,163,257 A * 11/1992 Crowell ..... E04C 2/543 52/584.1
5,546,713 A * 8/1996 Voegele, Jr. ..... E04D 3/08 52/204.597
6,141,923 A * 11/2000 Habicht ..... E04B 2/967 52/235
6,945,001 B1 * 9/2005 Suzuki ..... E04F 13/147 52/592.1
7,263,807 B2 * 9/2007 Gumpert ..... E04D 3/362 52/309.3
8,225,561 B2 * 7/2012 Voegele, Jr. ..... E04B 2/967 52/204.5
10,312,853 B2 * 6/2019 MacRostie ..... F24S 25/636
2006/0288645 A1 * 12/2006 Konstantino ..... E06B 9/24 49/92.1
2010/0146898 A1 * 6/2010 Pierson ..... E04D 3/365 52/549
2012/0233941 A1 * 9/2012 McLain ..... E04D 13/0315 52/302.1
2017/0022712 A1 * 1/2017 Nelson, Jr. ..... E04D 13/0315
2018/0283003 A1 * 10/2018 Stein ..... E04B 2/967
2020/0385993 A1 * 12/2020 McDonald ..... H02S 20/23

* cited by examiner

SKYLIGHT AND SMOKE VENT GUTTER UPLIFT CHANNEL ASSEMBLY

CROSS-REFERENCES TO RELATED APPLICATIONS

This application claims priority to and is a non-provisional application of U.S. Provisional Patent Application No. 62/896,536 entitled "SKYLIGHT AND SMOKE VENT GUTTER UPLIFT CHANNEL ASSEMBLY" filed on Sep. 5, 2019.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to roof curb systems and methods. More particularly, this invention pertains to systems and methods for securing multiple roof accessories to roofs with roof curbs.

Prior art curb mounted roof accessories (e.g., skylights and smoke vents) are attached to roofs in singular fashion on individual roof curbs because attachment to one another violates the fastening requirements specified by most unit manufacturers. For architects that seek linear arrangements of multiple units to achieve a strip of natural daylight into a space or a reduction in the quantity of roof penetrations, attachment of the roof accessories or units to roof curbs is compromised because fastening clearances are eliminated by the abutment of unit frames. The existing plate and baton method of attachment is cumbersome as meticulous welding often warps thin metal frames of the roof accessories at critical water-tight points compromising the durability and weather-tightness of the units as designed by the manufacturer. Therefore, such installations are prone to leaking and must be thoroughly sealed with mastic or caulk, which degrades relatively quickly.

BRIEF SUMMARY OF THE INVENTION

Aspects of the invention provide linking devices for roof accessories (e.g., skylights and smoke vents) installed on roofs with roof curb systems. They may be largely metallic and are designed to provide a weather tight seal between a pair of roof accessories while negating uplift imposed by external forces (e.g., high winds) on roof curb mounted skylights and/or smoke vents arranged in multiple, connected unit configurations. The accessories are linearly linked through a unique gutter assembly that is attached to a pair of roof curbs and includes a clamping member (e.g., uplift channel or cap) to provide uniform clamping that withstands uplift pressures. No modifications are needed to unit frames (i.e., accessory frames) and the ability of traditional roof curb mounted skylights and/or smoke vents to resist uplift is restored.

In one aspect, a gutter channel assembly for mounting roof accessories to a roof having a pair of longitudinally extending roof curbs includes a gutter and and uplift channel. The gutter is configured to extend laterally between the pair of roof curbs of the roof and to receive a longitudinal end of each roof accessory of a pair of roof accessories when the gutter channel assembly is installed on the roof. The uplift channel is configured to secure to the gutter and extend at least partially over the longitudinal ends of the pair of roof accessories received in the gutter when the gutter channel assembly is installed on the roof.

In another aspect, a method of installing a gutter channel assembly on a roof having a pair of longitudinally extending roof curbs include securing opposing lateral ends of the gutter of the gutter channel assembly to the pair of roof curbs. Longitudinal ends of a pair of roof accessories are placed between a pair of opposing sides of the gutter. A hole through an uplift channel is then placed over a threaded rod extending upwardly from the gutter such that longitudinal ends of the uplift channel extend at least partially over the longitudinal ends of the roof accessories received in the gutter. A nut of the gutter channel assembly is screwed onto the threaded rod to secure the uplift channel to the gutter channel and the roof accessories within the gutter.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
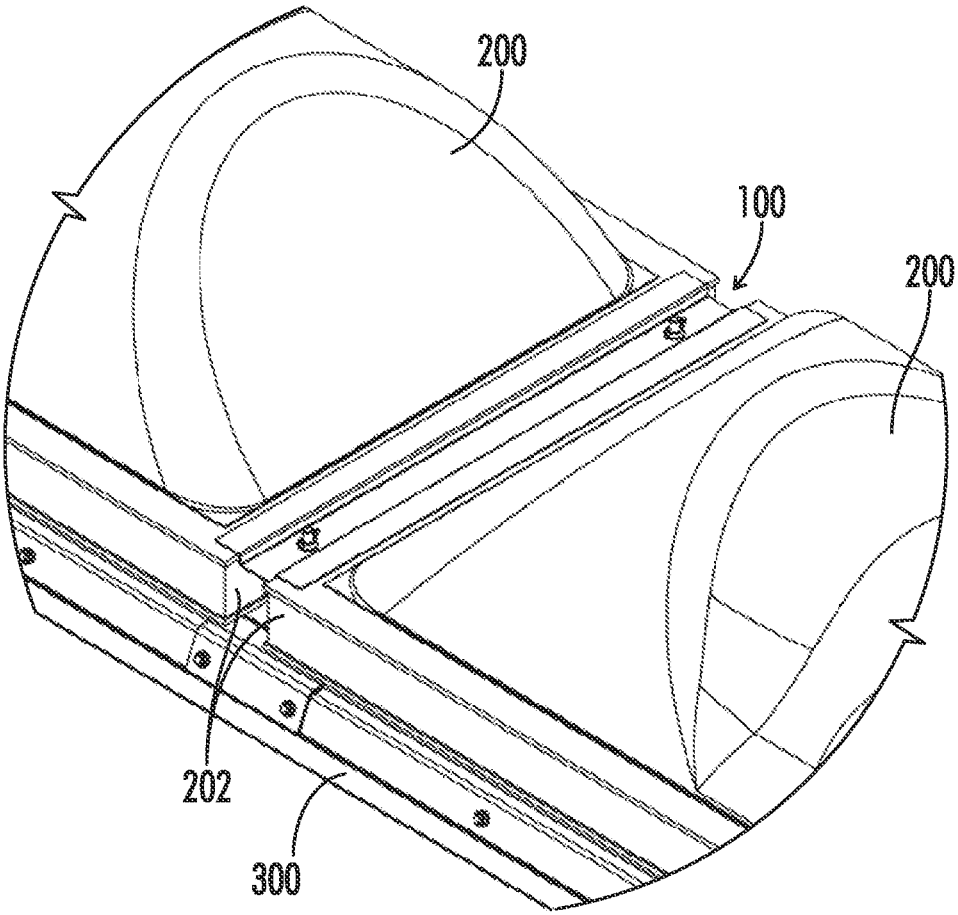
FIG. 1 is an isometric view of two roof curb mounted skylights joined by a gutter channel assembly.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position of the gutter channel assembly and roof accessories is determined when the system is installed on a generally horizontal pair of roof curbs to hold down adjacent skylights or smoke vents as shown in FIG. 1. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Skylight: a translucent panel that is mounted to the roof of a building for allowing daylight into the building and/or night sky viewing.

Smoke Vent: a vent that is mounted to the roof of a building and designed to open in response to an excessive heat trigger for the purpose of smoke evacuation in the event of a fire in the building.

Roof Curb: a raised weather-tight roof top mounting apparatus for the purpose of liaising roof mounted equipment through an opening in the roof.

Gutter: a low area with walls forming a trough that is used to direct water.

Uplift: an upward force exerted on an object that has the potential to raise it relative to its surroundings.

Referring now to FIGS. 1-7, in one embodiment, a gutter uplift channel assembly 100 is configured to mount skylights and/or smoke vents 200 to a roof having roof curbs 300. The assembly is dimensionally configurable for all size roof curb mounted skylight and smoke vent units that are arranged in a linear strip fashion. Linear strips of skylights and smoke vents have become prevalent in commercial, industrial, warehousing, and institutional buildings, but the assembly 100 may be used on any roof curb based roofing system in any market segment.

In one embodiment, a gutter channel assembly 100 is used for mounting roof accessories 202 roof having a pair of longitudinally extending roof curbs 300. The gutter channel assembly 100 includes a gutter 102 and an uplift channel 104.

The gutter 102 is configured to extend laterally between the pair of roof curbs 300 of the roof and to receive a longitudinal end 202 of each roof accessory 200 of a pair of roof accessories when the gutter channel assembly 100 is installed on the roof. In one embodiment, the gutter channel assembly 100 further includes at least one threaded rod 106 extending upwardly from the gutter 102 when the gutter 102 is installed on the roof. In one embodiment, the gutter 102 includes an inner wall 402 (see FIG. 4) and an outer wall 502 (see FIG. 5). In one embodiment, the outer wall 502 is spaced from the inner wall 402 and attached to the inner wall 402 at longitudinal ends 404 of the inner wall 402. In one embodiment, a space between the inner wall 402 and outer wall 502 is at least partially or substantially filled with insulation 504. In one embodiment, the outer wall 502 has a lateral length 506 less than a lateral length 406 of the inner wall 402. In one embodiment, the difference in lateral length between the outer wall 502 and inner wall 402 is configured to allow roof curbs 300 to extend up between the outer wall 502 and a lateral end wall 410 of the gutter 102.

In one embodiment, the inner wall 402 of the gutter 102 includes a bottom 420, a first side 422, a second side 424, a first rail 423, and a second rail 425. The bottom 420 extends laterally and generally horizontal between the roof curbs 300 when the gutter channel assembly 100 is installed on a generally horizontal roof. The first side 422 extends generally upward from a first longitudinal edge 430 of the bottom 420 when the gutter channel assembly 100 is installed on the roof. The first rail 423 extends longitudinally outward and generally horizontally from a top edge 431 of the first side 422 when the gutter channel assembly 100 is installed on the roof. An outward edge 432 of the first rail 423 forms a first longitudinal end 404 of the gutter 102. The second side 424 extends generally upward from a second longitudinal edge 440 of the bottom 420 opposite the first longitudinal edge 430 of the bottom 420 when the gutter channel is simply 100 is installed on the roof. The second rail 425 extends longitudinally outward and generally horizontally from a top edge 441 of the second side 424 when the gutter channel assembly 100 is installed on the roof. An outward edge 442 of the second rail 425 forms a second longitudinal end 484 of the gutter 102 opposite the first longitudinal end 404 of the gutter 102. In one embodiment, the gutter 102 further includes the first longitudinal end 404 extending downward from the outer longitudinal edge 432 of the first rail 423 when the gutter channel assembly 100 is installed on the roof in one embodiment, the gutter 102 further includes the second longitudinal end 484 extending downward from the outer longitudinal edge 442 of the second rail 425 when the gutter channel simply 100 is installed on the roof. In one embodiment, the bottom 420, first side 422, first rail 423, first longitudinal end 404, second side 424, second longitudinal end 484, and second rail 425 are all integrally formed such as by stamping and folding sheet-metal. In one embodiment, the distance between the first side 422 of the inner wall 402 of the gutter 102 and the second side 424 of the inner wall 402 of the gutter 102 and a longitudinal depth of the first rail 423 and second rail 425 are selected to allow the gutter 102 to receive the rim 202 of the first roof accessory 200 and the rim 202 of the second roof accessory 200 such that the uplift channel 104 secures the rim 202 of the first accessory 200 and the rim 202 of the second accessory 200 into the gutter 102 when the gutter channel assembly 100 is installed on the roof.

In one embodiment, the outer wall 502 of the gutter 102 includes a bottom 520, a first side 524, and a second side 526. The bottom 520 extends laterally and generally horizontal when the gutter channel assembly is installed on a generally horizontal roof. The first side 524 extends generally upward from a first longitudinal edge 525 of the bottom 520 when the gutter channel assembly 100 is installed on the roof. The first side 524 of the inner wall 502 is attached to the first longitudinal end 404 of the inner wall 402 when the gutter channel assembly 100 is installed on the roof. The second side 526 extends generally upward from a second longitudinal edge 527 of the bottom 520 when the gutter channel simply 100 is installed on the roof. The second side 526 of the inner wall 502 is attached to the second longitudinal end 484 of the inner wall 402 when the gutter channel assembly 100 is installed on the roof. In one embodiment, the first side 524 is attached to the first longitudinal end 404 and the second side 526 is attached to the second longitudinal end 484 via spot welding or riveting.

In one embodiment, the gutter 102 further includes a first lateral end wall 410 and a second lateral end wall 411. The first lateral end wall 410 is attached to a first lateral end of the bottom 420, first side 422, second side 424, first rail 423, and second rail 425. The first lateral end wall 410 extends down at least as far as the bottom 420 when the gutter 102 is in a horizontal and upright position (i.e., installed on the roof). The second lateral end wall 411 is attached to a second lateral end opposite the first lateral end of the bottom 420 first side 422, second side 424, first rail 423, and second rail 425. The second lateral end wall 411 extends down at least as far as the bottom 420 when the gutter 102 is installed on the roof. The first lateral in wall 410 and second lateral end wall 411 are configured to contact the roof curbs 300 when installed on the roof and allow the gutter 1 or 2 to secure to the roof curbs 300 via fasteners or adhesives. The gutter 102 is configured to channel water laterally over the roof curbs 300 and first lateral end wall 410 and second lateral end wall 411 when the gutter 102 is installed on the roof.

In one embodiment, the gutter channel assembly 100 further includes a section of C channel 702 having a plurality of holes there through. The gutter channel assembly 100 further includes a plurality of threaded rods 106 each rod of the plurality of threaded rods 106 extending upwardly through the whole of the plurality of holes in the C channel 702 when the gutter channel assembly 100 is installed on the roof. An open side of the C channel 702 is secured to the gutter 102 when the gutter assembly 100 is installed on the roof. In one embodiment, the open end of the C channel 72 is welded to the bottom 420 of the inner wall 402 of the gutter 102. In one embodiment, the gutter channel assembly 100 further includes a plurality of nuts 704, each nut threaded onto a rod 106 of the plurality of threaded rods down to the sea channel 702 when the gutter channel simply 100 is installed on the roof. In one embodiment, the gutter channel assembly 100 further includes at least one nut 110 configured to engage the threaded rod 106 when the gutter channel assembly 100 is installed on the roof such that the nut 110 secures the uplift channel 104 to the gutter 102 and retains the longitudinal ends 202 of each of the roof accessories 200 received in the gutter 102 in the gutter 102.

The uplift channel 104 is configured to secure to the gutter 102 and extend at least partially over the longitudinal ends 202 of the roof accessories 200 received in the gutter 102 when the gutter channel assembly 100 is installed on the roof. In one embodiment, the uplift channel 104 has a whole 108 there through configured to receive the threaded rod 106 of the gutter 102 when the gutter channel assembly 100 is installed on the roof. In one embodiment, the uplift channel 104 is flat, and in another embodiment, the uplift channel is recessed along a lateral centerline of the uplift channel 104.

Figure 2:
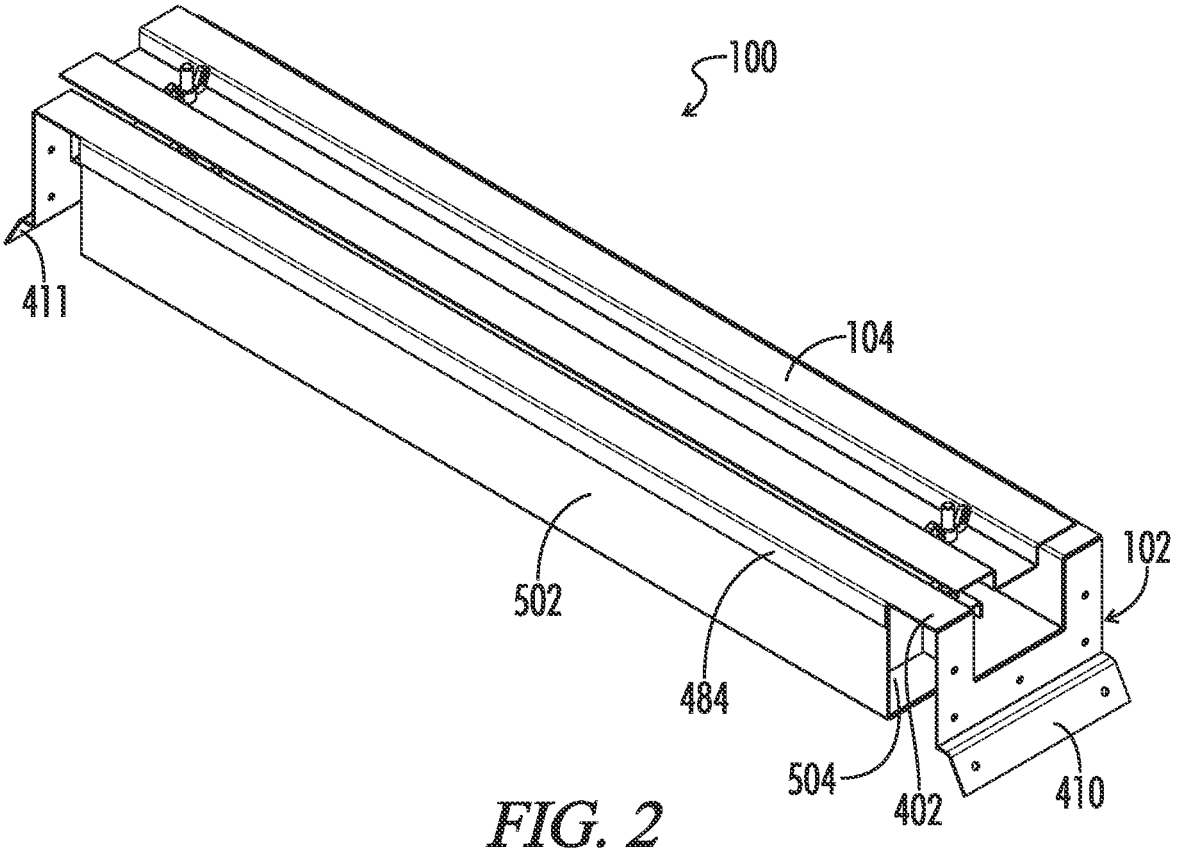
FIG. 2 is an isometric view of the gutter channel assembly of FIG. 1.
Figure 3:
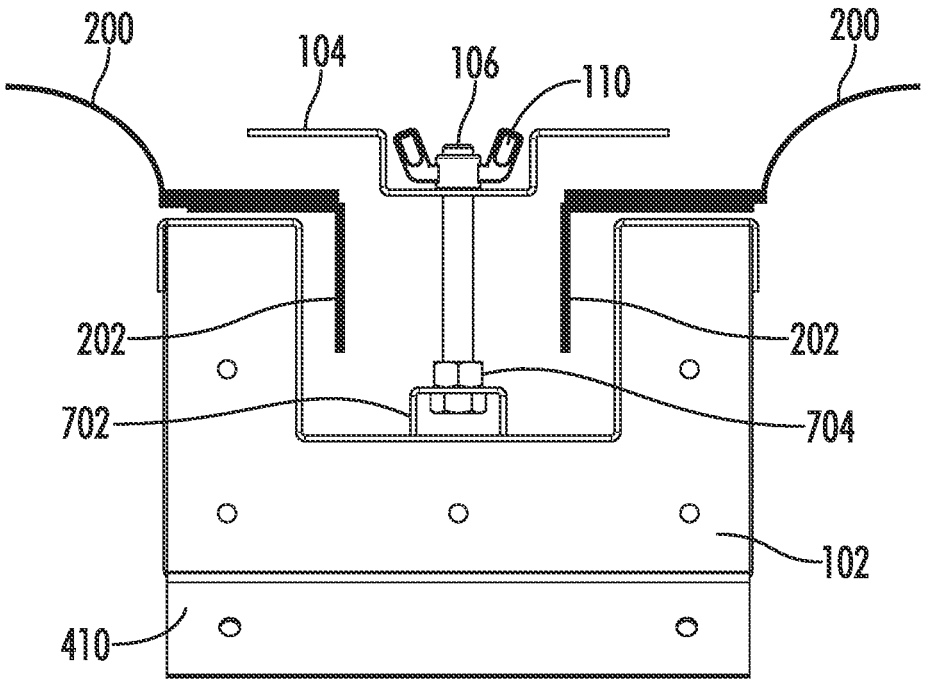
FIG. 3 is a perspective view of a lateral end of the gutter channel assembly and roof accessories of FIG. 1.
Figure 4:
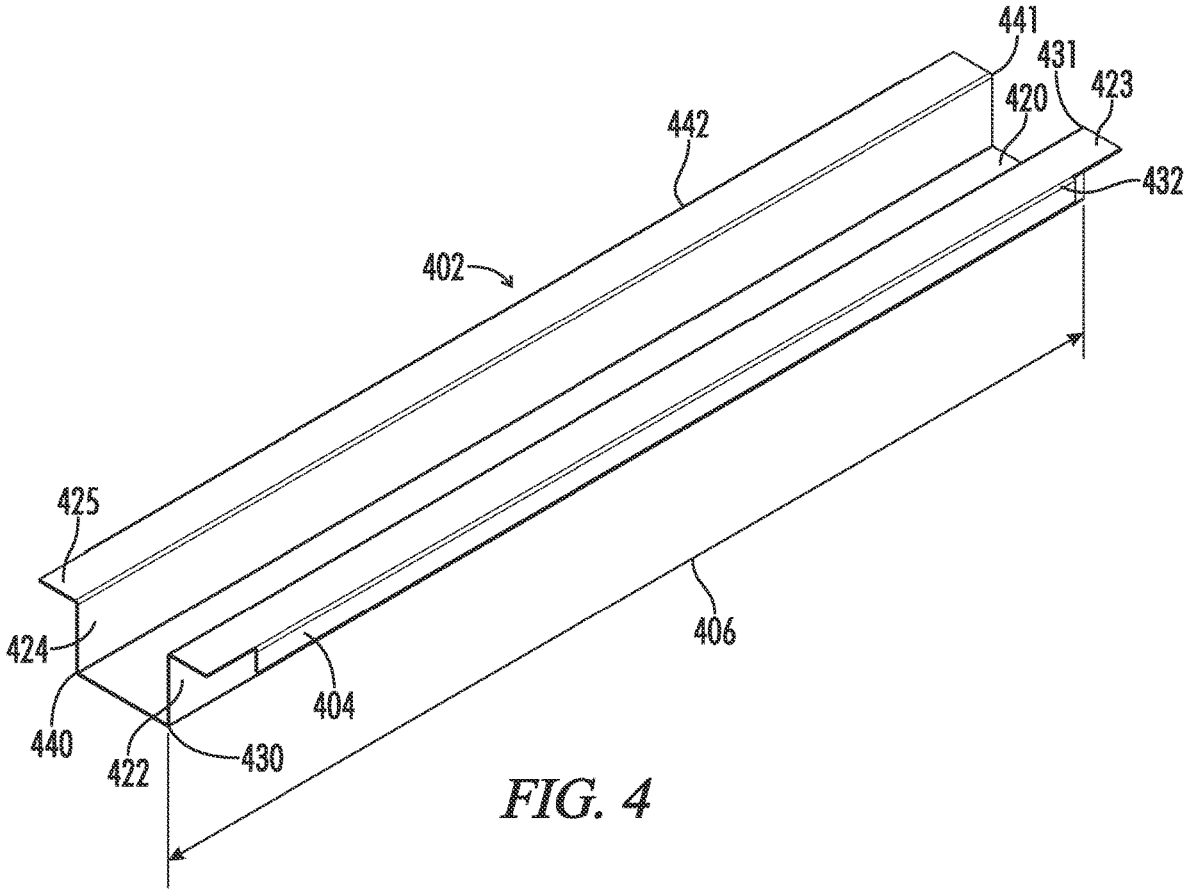
FIG. 4 is an isometric view of an inner wall of the gutter of the gutter channel assembly of FIG. 1.
Figure 5:
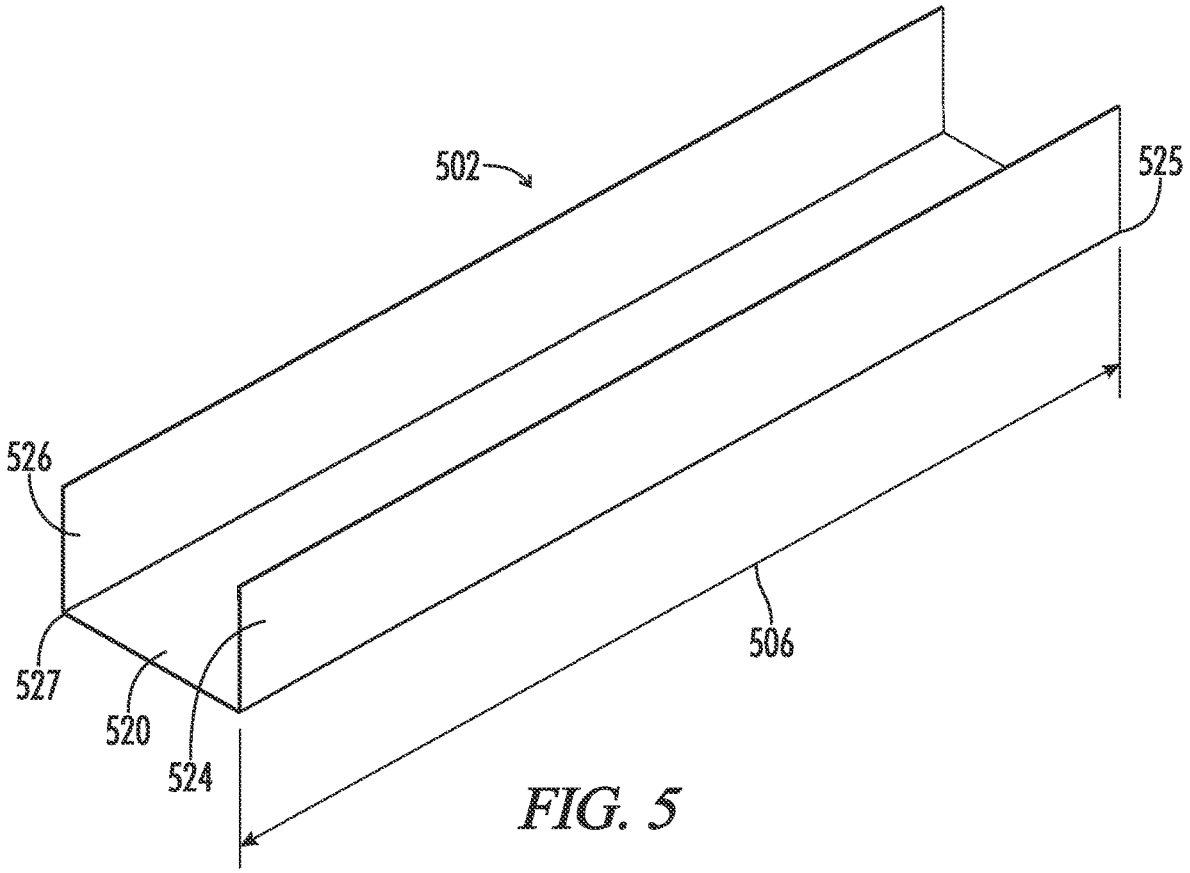
FIG. 5 is an isometric view of an outer wall of the gutter of the gutter channel assembly of FIG. 1.
Figure 6:
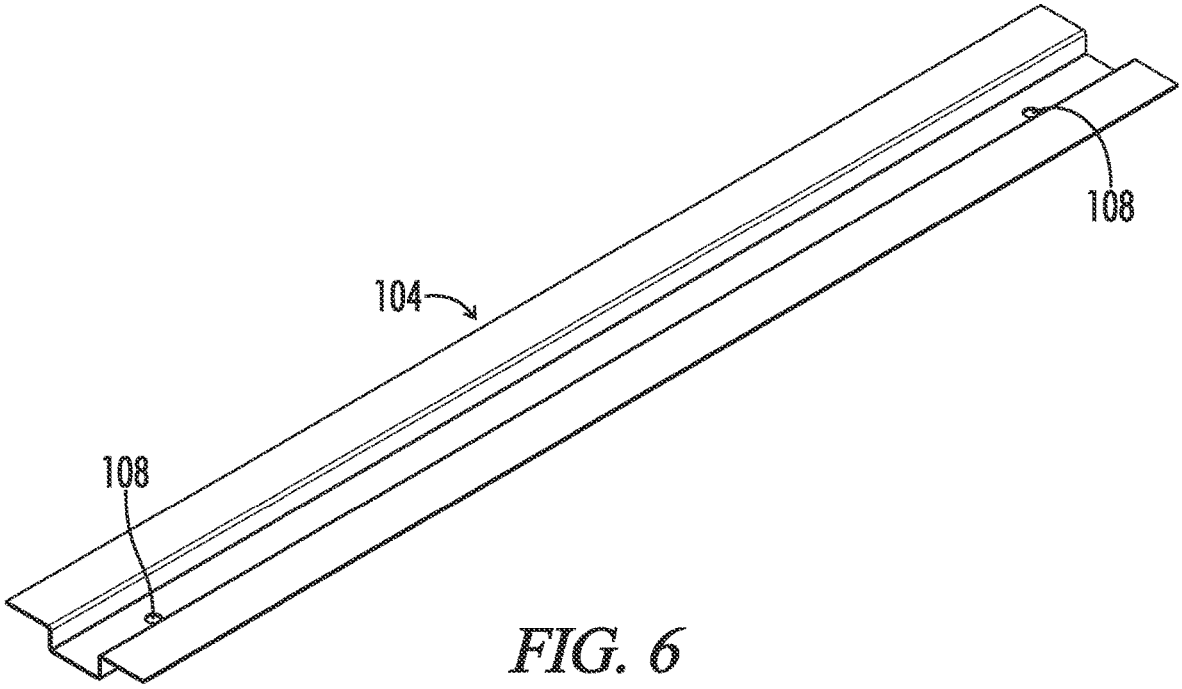
FIG. 6 is an isometric view of the uplift channel of the gutter channel assembly of FIG. 1.
Figure 7:
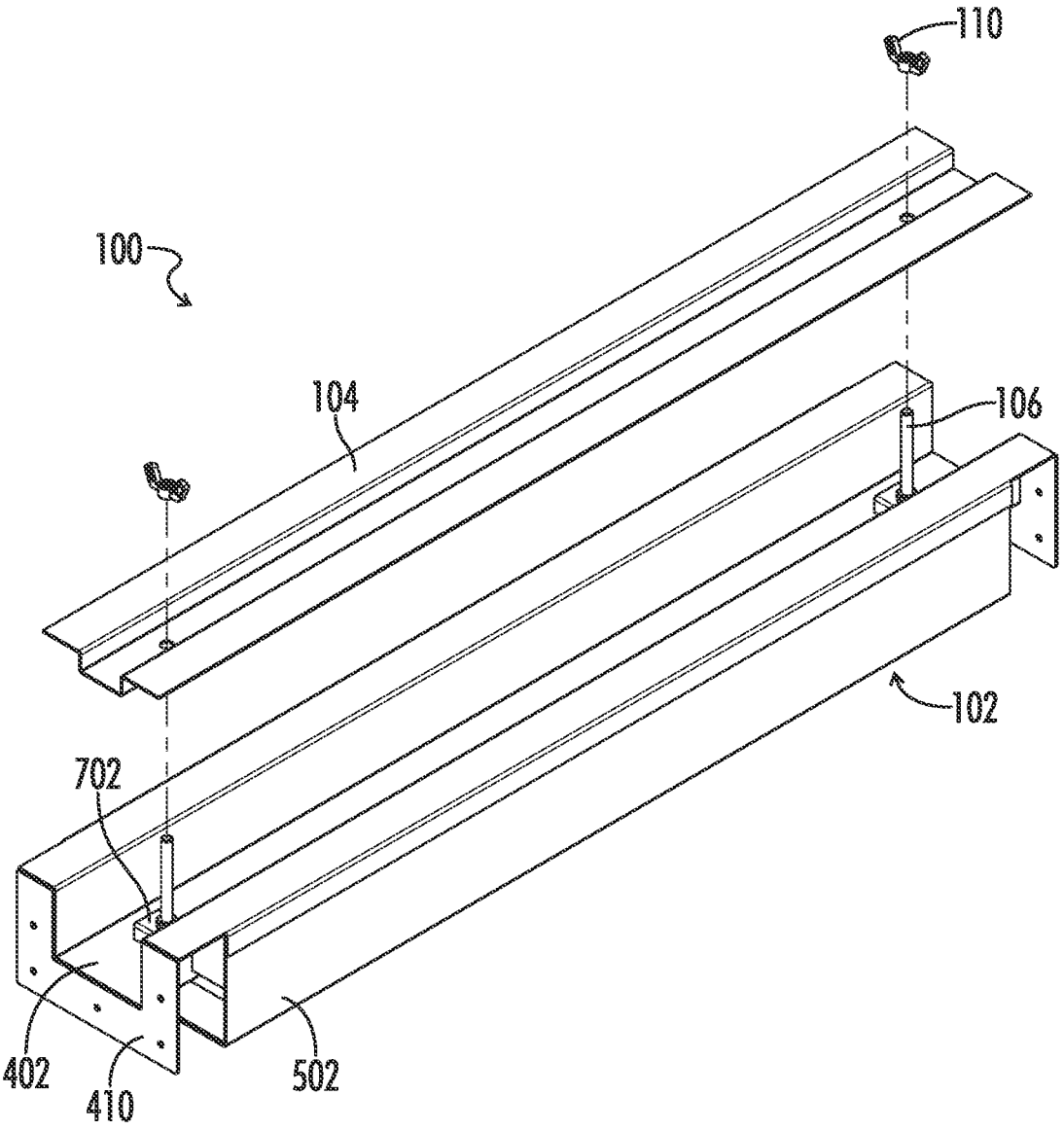
FIG. 7 is an isometric partially exploded view of another embodiment of a gutter channel assembly having a gutter with generally flat lateral end walls.

In the embodiment of FIGS. 1-3, the lateral ends 410, 411 of the gutter 102 extend laterally outward and below bottom 420 of the inner wall 402 for use with some roof curb systems. In the embodiment of FIG. 7, the lateral ends 410, 411 of the gutter 102 extend vertically even with the bottom 420 of the inner wall 402. The embodiment of FIG. 7 may have attachments affixed to the lateral ends 410, 411 to secure the gutter 102 to the roof curbs 300, or the lateral ends 410, 411 may attach directly to the roof curbs 300, depending on the type of roof curb system 300 on the roof.

In one embodiment, the gutter uplift channel assembly 100 includes roof curb gutter 102 and uplift channel 104 which attach to one another with an offset to accommodate specific skylight and/or smoke vent frame dimensions which may vary among unit manufacturers. The roof curb gutter 102 and uplift channel 104 may be made of metal, vinyl, or some other material such as a polymer. The roof curb gutter 102 is attached to roof curbs 300 and extends laterally between the roof curbs 300. The skylights and/or smoke vents 200 being placed adjacent one another in a row or column are set onto the roof curb gutter 102 such that any water shed from the end 202 of the skylight and/or smoke vent 200 is directed into the gutter 102 and laterally outward past the roof curbs 300 that the roof curb gutter 102 extends between. The uplift channel 104 applies downward force to the frames (of the adjacent skylights and/or smoke vents) to maintain the ends 202 of the adjacent skylights and/or smoke vents 200 in the roof curb gutter 102 and resist uplift in high wind situations. In one embodiment, at least one (e.g., a pair of) threaded rods 106 extend upwardly from the gutter 102, and through corresponding hole(s) 108 in the uplift channel 104. A nut 110 (e.g., wing nut) secures the uplift channel 104 to the threaded rods 106 (e.g., bolts) and thus to the roof curb gutter 102.

In one embodiment, the uplift channel 104 is a formed hat channel shape specifically designed with clearances to allow consistent alignment with the skylight and/or smoke vent frames 202 to the roof curb 300 through the applied downward force when fastened to the roof curb gutter 102 via the one or more threaded rods (e.g., bolts) 106. The recessed center section of the uplift channel 104 with pre-punched holes 108 coordinating with the gutter 102 through bolts 106 is dimensioned to provide the applicable strength for uniform pressures to be applied via the through bolt attachment depicted within FIG. 1. The uplift channel 104 and upwardly extending threaded rods 106 may include any number of rods and corresponding holes 108 in the uplift channel 104, and may be any pattern (e.g., uneven or offset from center).

In one embodiment, the roof curb gutter 102 portion of the assembly 100 is designed to nest and attach via the pre-punched holes to the modified roof curb wall 300 that adjoins the skylights and/or smoke vents 200. The roof curb gutter 102 seals appropriately to the roof curb 300 and roofing material (e.g., sidewalls) dependent on the construction roofing type with applicable construction sealants, and fastens via structural screws, rivets, or welds with its longitudinal positioning based on the skylight and/or smoke vent 200 unit length to provide the bearing point for the adjacent unit (i.e., roof accessory) frames.

In one embodiment, the through bolt 106 attachment is integrated to the roof curb gutter 102. A threaded bolt 106 is fastened to a top of the gutter 102 bottom 420 trough via mechanical attachment to provide adequate support to resist uplift forces. The gutter 102 is not limited solely to this curb wall application, installation procedure, or attachment method.

Referring to FIG. 1, curb 300 mounted skylights 200 abutted in lineal, longitudinal fashion are depicted to display the function of the invention in an installed fashion including the gutter uplift channel assembly 104 and two joined skylights 200 (i.e., roof accessories). The roof curb gutter 102 is mounted to the modified roof curb wall 300 (i.e., to the skylight sidewalls) allowing the skylights to properly sit without modification on the perimeter frame (i.e., sidewalls and roof curb gutter) as designed by the skylight or smoke vent unit manufacturer. The uplift channel 104 is securely fastened via the through bolt 106 attachments which allow the skylights 200 to resist upward pressures to remain in place on the roof curb wall 300 and gutter support 102 as intended from the skylight manufacturer for proper weathertightness. The gutter uplift channel assembly 100 is not limited to the application of skylights and/or smoke vents, the depicted arrangement of skylights and/or smoke vents, perceived size of the assembly, or the attachment method described herein.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful SKYLIGHT AND SMOKE VENT GUTTER UPLIFT CHANNEL ASSEMBLY it is not intended that such references be construed as limitations upon the scope of this invention except as set forth in the following claims.

What is claimed is:

1. A gutter channel assembly for mounting roof accessories to a roof having a pair of longitudinally extending roof curbs, said gutter channel assembly comprising:

a gutter configured to extend laterally between the pair of roof curbs of the roof, and to receive a longitudinal end of each roof accessory of a pair of roof accessories when the gutter channel assembly is installed on the roof, wherein the gutter comprises:

an inner wall comprising:

a bottom extending laterally and generally horizontal when the gutter channel assembly is installed on the roof;

a first side extending generally upward from a first longitudinal edge of the bottom when the gutter channel assembly is installed on the roof;

a first rail extending longitudinally outward and generally horizontally from a top edge of the first side when the gutter channel assembly is installed on the roof, wherein an outward edge of the first rail forms a first longitudinal end of the gutter;

a first longitudinal end extending downward from an outer longitudinal edge of the first rail when the gutter channel assembly is installed on the roof;

a second side extending generally upward from a second longitudinal edge of the bottom opposite the first longitudinal edge of the bottom when the gutter channel assembly is installed on the roof;

a second rail extending longitudinally outward and generally horizontally from a top edge of the second side when the gutter channel assembly is installed on the roof; and a second longitudinal end extending downward from an outer longitudinal edge of the second rail when the gutter channel assembly is installed on the roof, wherein an outward edge of the second rail forms a second longitudinal end of the gutter opposite the first longitudinal end of the gutter;

a first lateral end wall attached to a first lateral end of the bottom, first side, second side, first rail, and second rail, said first lateral end wall extending down at least as far as the bottom when the gutter is in a horizontal and upright position; and a second lateral end wall attached to a second lateral end opposite the first lateral end of the bottom, first side, first rail, and second rail, said second lateral end wall extending down at least as far as the bottom when the gutter is in the horizontal and upright position, wherein:

the first lateral end wall and second lateral end wall are configured to contact the roof curbs when installed on the roof and allow the gutter to secure to the roof curbs via fasteners or adhesives;

the gutter is configured to channel water laterally over the roof curbs and first lateral end wall and second lateral end wall when the gutter is installed on the roof;

a distance between the first side of the inner wall of the gutter and the second side of the inner wall of the gutter and a longitudinal depth of the first rail and second rail are selected to allow the gutter to receive a rim of the first roof accessory and a rim of the second roof accessory such that the uplift channel secures the rim of the first roof accessory and the rim of the second roof accessory into the gutter when the gutter channel assembly is installed on the roof; and an uplift channel configured to secure to the gutter and extend at least partially over the longitudinal ends of the pair of roof accessories received in the gutter when the gutter channel assembly is installed on the roof.

2. The gutter channel assembly of claim 1, wherein:

the gutter channel assembly further comprises at least one threaded rod extending upwardly from the gutter;

the uplift channel has a hole therethrough configured to receive the threaded rod when the gutter channel assembly is installed on the roof; and the gutter channel assembly further comprises a nut configured to engage the threaded rod when the gutter channel assembly is installed on the roof such that the nut secures the uplift channel to the gutter and retains the longitudinal ends of the each of the roof accessories received in the gutter.

3. The gutter channel assembly of claim 1, wherein the gutter further comprises:

an outer wall spaced from the inner wall, wherein the outer wall is attached to the inner wall at the first and second longitudinal ends of the inner wall wherein:

a space between the inner wall and the outer wall is substantially filled with insulation.

4. The gutter channel assembly of claim 1, wherein the gutter further comprises:

an outer wall spaced from the inner wall, wherein the outer wall is attached to the inner wall at the first and second longitudinal ends of the inner wall wherein:

the outer wall has a lateral length less than a lateral length of the inner wall.

5. The gutter channel assembly of claim 1, wherein the gutter further comprises:

an outer wall comprising:

a bottom extending laterally and generally horizontal when the gutter channel assembly is installed on the roof;

a first side extending generally upward from a first longitudinal edge of the bottom when the gutter channel assembly is installed on the roof, wherein the first side of the inner wall is attached to the first longitudinal end of the inner wall when the gutter channel assembly is installed on the roof; and a second side extending generally upward from a second longitudinal edge of the bottom opposite the first longitudinal edge of the bottom when the gutter channel assembly is installed on the roof, wherein the second side of the inner wall is attached to the second longitudinal end of the inner wall when the gutter channel assembly is installed on the roof; and insulation substantially filling a space between the inner wall and the outer wall.

6. The gutter channel assembly of claim 1, wherein:

the gutter channel assembly further comprises a section of C-channel having a plurality of holes therethrough;

the gutter channel assembly further comprises a plurality of threaded rods, each rod of the plurality of threaded rods extending upwardly through a hole of the plurality of holes in the C-channel when the gutter channel assembly is installed on the roof; and an open side of the C channel is secured to the gutter when the gutter assembly is installed on the roof.

7. The cutter channel assembly of claim 1, wherein:

the gutter channel assembly further comprises a section of C-channel having a plurality of holes therethrough;

the gutter channel assembly further comprises a plurality of threaded rods, each rod of the plurality of threaded rods extending upwardly through a hole of the plurality of holes in the C-channel when the gutter channel assembly is installed on the roof;

an open side of the C channel is secured to the gutter when the gutter assembly is installed on the roof the C-channel is welded to the gutter;

the gutter channel assembly further comprises a plurality of nuts, each nut threaded onto a rod of the plurality of threaded rods down to the C-channel when the gutter channel assembly is installed on the roof; and the gutter channel assembly further comprises at least one nut configured to secure the uplift channel onto at least one of the threaded rods when the gutter channel assembly is installed on the roof.

8. A method of installing a gutter channel assembly on a roof having a pair of longitudinally extending roof curbs, said method comprising:

securing opposing lateral ends of a gutter of the gutter channel assembly to the pair of roof curbs;

placing longitudinal ends of a pair of roof accessories between a pair of opposing sides of the gutter;

placing a hole through an uplift channel over a threaded rod extending upwardly from the gutter such that longitudinal ends of the uplift channel extend at least partially over the longitudinal ends of the roof accessories received in the gutter; and screwing a nut of the gutter channel assembly onto the threaded rod to secure the uplift channel to the gutter, wherein the gutter comprises:

an inner wall comprising:

a bottom extending laterally and generally horizontal when the gutter channel assembly is installed on the roof;

a first side extending generally upward from a first longitudinal edge of the bottom when the gutter channel assembly is installed on the roof;

a first rail extending longitudinally outward and generally horizontally from a top edge of the first side when the gutter channel assembly is installed on the roof, wherein an outward edge of the first rail forms a first longitudinal end of the gutter;

a first longitudinal end extending downward from an outer longitudinal edge of the first rail when the gutter channel assembly is installed on the roof;

a second side extending generally upward from a second longitudinal edge of the bottom opposite the first longitudinal edge of the bottom when the gutter channel assembly is installed on the roof;

a second rail extending longitudinally outward and generally horizontally from a top edge of the second side when the gutter channel assembly is installed on the roof; and a second longitudinal end extending downward from an outer longitudinal edge of the second rail when the gutter channel assembly is installed on the roof, wherein an outward edge of the second rail forms a second longitudinal end of the gutter opposite the first longitudinal end of the gutter;

a first lateral end wall attached to a first lateral end of the bottom, first side, second side, first rail, and second rail, said first lateral end wall extending down at least as far as the bottom when the gutter is in a horizontal and upright position; and a second lateral end wall attached to a second lateral end opposite the first lateral end of the bottom, first side, first rail, and second rail, said second lateral end wall extending down at least as far as the bottom when the gutter is in the horizontal and upright position, wherein:

the first lateral end wall and second lateral end wall are configured to contact the roof curbs when installed on the roof and allow the gutter to secure to the roof curbs via fasteners or adhesives;

the gutter is configured to channel water laterally over the roof curbs and first lateral end wall and second lateral end wall when the gutter is installed on the roof:

a distance between the first side of the inner wall of the gutter and the second side of the inner wall of the gutter and a longitudinal depth of the first rail and second rail are selected to allow the gutter to receive a rim of the first roof accessory and a rim of the second roof accessory such that the uplift channel secures the rim of the first roof accessory and the rim of the second roof accessory into the gutter when the gutter channel assembly is installed on the roof.

9. The method of claim 8, wherein:

the gutter channel assembly further comprises at least one threaded rod extending upwardly from the gutter;

the uplift channel has a hole therethrough configured to receive the threaded rod when the gutter channel assembly is installed on the roof; and the gutter channel assembly further comprises a nut configured to engage the threaded rod when the gutter channel assembly is installed on the roof such that the nut secures the uplift channel to the gutter and retains the longitudinal ends of each of the roof accessories received in the gutter.

10. The method of claim 8, wherein the gutter further comprises:

an outer wall spaced from the inner wall, wherein the outer wall is attached to the inner wall at the first and second longitudinal ends of the inner wall wherein:

a space between the inner wall and the outer wall is substantially filled with insulation.

11. The method of claim 8, wherein the gutter further comprises:

an outer wall spaced from the inner wall, wherein the outer wall is attached to the inner wall at the first and second longitudinal ends of the inner wall, wherein:

the outer wall has a lateral length less than a lateral length of the inner wall.

12. The method of claim 8, wherein the gutter further comprises:

an outer wall comprising:

a bottom extending laterally and generally horizontal when the gutter channel assembly is installed on the roof;

a first side extending generally upward from a first longitudinal edge of the bottom when the gutter channel assembly is installed on the roof, wherein the first side of the inner wall is attached to the first longitudinal end of the inner wall when the gutter channel assembly is installed on the roof; and a second side extending generally upward from a second longitudinal edge of the bottom opposite the first longitudinal edge of the bottom when the gutter channel assembly is installed on the roof, wherein the second side of the inner wall is attached to the second longitudinal end of the inner wall when the gutter channel assembly is installed on the roof; and insulation substantially filling a space between the inner wall and the outer wall.

13. The method of claim 8, wherein:

the gutter channel assembly further comprises a section of C-channel having a plurality of holes therethrough;

the gutter channel assembly further comprises a plurality of threaded rods, each rod of the plurality of threaded rods extending upwardly through a hole of the plurality of holes in the C-channel when the gutter channel assembly is installed on the roof; and an open side of the C channel is secured to the gutter when the gutter assembly is installed on the roof.

14. The method of claim 8, wherein:

the gutter channel assembly further comprises a section of C-channel having a plurality of holes therethrough;

the gutter channel assembly further comprises a plurality of threaded rods, each rod of the plurality of threaded rods extending upwardly through a hole of the plurality of holes in the C-channel when the gutter channel assembly is installed on the roof;

an open side of the C channel is secured to the gutter when the gutter assembly is installed on the roof the C-channel is welded to the gutter;

the gutter channel assembly further comprises a plurality of nuts, each nut threaded onto a rod of the plurality of threaded rods down to the C-channel when the gutter channel assembly is installed on the roof; and the gutter channel assembly further comprises at least one nut configured to secure the uplift channel onto at least one of the threaded rods when the gutter channel assembly is installed on the roof.

15. A gutter channel assembly for mounting roof accessories to a roof having a pair of longitudinally extending roof curbs, said gutter channel assembly comprising:

a gutter configured to extend laterally between the pair of roof curbs of the roof, and to receive a longitudinal end of each roof accessory of a pair of roof accessories when the gutter channel assembly is installed on the roof, wherein the gutter comprises:

an inner wall comprising:

a bottom extending laterally and generally horizontal when the gutter channel assembly is installed on the roof;

a first side extending generally upward from a first longitudinal edge of the bottom when the gutter channel assembly is installed on the roof;

a first rail extending longitudinally outward and generally horizontally from a top edge of the first side when the gutter channel assembly is installed on the roof, wherein an outward edge of the first rail forms a first longitudinal end of the gutter;

a first longitudinal end extending downward from an outer longitudinal edge of the first rail when the gutter channel assembly is installed on the roof;

a second side extending generally upward from a second longitudinal edge of the bottom opposite the first longitudinal edge of the bottom when the gutter channel assembly is installed on the roof;

a second rail extending longitudinally outward and generally horizontally from a top edge of the second side when the gutter channel assembly is installed on the roof; and a second longitudinal end extending downward from an outer longitudinal edge of the second rail when the gutter channel assembly is installed on the roof; wherein:

an outward edge of the second rail forms a second longitudinal end of the gutter opposite the first longitudinal end of the gutter; and the bottom, first side, first rail, first longitudinal end, second side, second longitudinal end, and second rail are all integrally formed;

an outer wall comprising:

a bottom extending laterally and generally horizontal when the gutter channel assembly is installed on the roof;

a first side extending generally upward from a first longitudinal edge of the bottom when the gutter channel assembly is installed on the roof, wherein the first side of the inner wall is attached to the first longitudinal end of the inner wall when the gutter channel assembly is installed on the roof; and a second side extending generally upward from a second longitudinal edge of the bottom opposite the first longitudinal edge of the bottom when the gutter channel assembly is installed on the roof, wherein the second side of the inner wall is attached to the second longitudinal end of the inner wall when the gutter channel assembly is installed on the roof; and insulation substantially filling a space between the inner wall and the outer wall; and an uplift channel configured to secure to the gutter and extend at least partially over the longitudinal ends of the pair of roof accessories received in the gutter when the gutter channel assembly is installed on the roof.

16. A method of installing a gutter channel assembly on a roof having a pair of longitudinally extending roof curbs, said method comprising:

securing opposing lateral ends of a gutter of the gutter channel assembly to the pair of roof curbs;

placing longitudinal ends of a pair of roof accessories between a pair of opposing sides of the gutter;

placing a hole through an uplift channel over a threaded rod extending upwardly from the gutter such that longitudinal ends of the uplift channel extend at least partially over the longitudinal ends of the roof accessories received in the gutter; and screwing a nut of the gutter channel assembly onto the threaded rod to secure the uplift channel to the gutter channel, wherein the gutter comprises:

an inner wall comprising:

a bottom extending laterally and generally horizontal when the gutter channel assembly is installed on the roof;

a first side extending generally upward from a first longitudinal edge of the bottom when the gutter channel assembly is installed on the roof;

a first rail extending longitudinally outward and generally horizontally from a top edge of the first side when the gutter channel assembly is installed on the roof, wherein an outward edge of the first rail forms a first longitudinal end of the gutter;

a first longitudinal end extending downward from an outer longitudinal edge of the first rail when the gutter channel assembly is installed on the roof;

a second side extending generally upward from a second longitudinal edge of the bottom opposite the first longitudinal edge of the bottom when the gutter channel assembly is installed on the roof;

a second rail extending longitudinally outward and generally horizontally from a top edge of the second side when the gutter channel assembly is installed on the roof; and a second longitudinal end extending downward from an outer longitudinal edge of the second rail when the gutter channel assembly is installed on the roof; wherein:

an outward edge of the second rail forms a second longitudinal end of the gutter opposite the first longitudinal end of the gutter; and the bottom, first side, first rail, first longitudinal end, second side, second longitudinal end, and second rail are all integrally formed;

an outer wall comprising:

a bottom extending laterally and generally horizontal when the gutter channel assembly is installed on the roof;

a first side extending generally upward from a first longitudinal edge of the bottom when the gutter channel assembly is installed on the roof, wherein the first side of the inner wall is attached to the first longitudinal end of the inner wall when the gutter channel assembly is installed on the roof; and a second side extending generally upward from a second longitudinal edge of the bottom opposite the first longitudinal edge of the bottom when the gutter channel assembly is installed on the roof, wherein the second side of the inner wall is attached to the second longitudinal end of the inner wall when the gutter channel assembly is installed on the roof; and insulation substantially filling a space between the inner wall and the outer wall.

* * * * *